US008579405B2

(12) United States Patent
Huyghen et al.

(10) Patent No.: US 8,579,405 B2
(45) Date of Patent: Nov. 12, 2013

(54) METHOD AND APPARATUS FOR DETECTING A MEDIA TOUCH OF AN INKJET PRINTHEAD

(75) Inventors: Johannes H. Huyghen, Venlo (NL); Franciscus J. W. M. Wolters, Nijmegen (NL); Stefan A. C. J. Winteraeken, Roermond (NL); Henricus W. C. Douven, Nederweert Eind (NL); Mike P. Van Eekhout, Oosterbeek (NL); Hubertus M. J. M. Boesten, Melick (NL)

(73) Assignee: OCE-Technologies B.V., Venlo (NL)

( * ) Notice: Subject to any disclaimer, the term of this patent is extended or adjusted under 35 U.S.C. 154(b) by 434 days.

(21) Appl. No.: 12/400,560

(22) Filed: Mar. 9, 2009

(65) Prior Publication Data

US 2009/0225119 A1 Sep. 10, 2009

(30) Foreign Application Priority Data

Mar. 10, 2008 (EP) ..... 08152526

(51) Int. Cl.
*B41J 29/393* (2006.01)
*B41J 25/308* (2006.01)

(52) U.S. Cl.
USPC ..... 347/19; 347/5; 347/8; 347/9; 347/14; 347/20

(58) Field of Classification Search
USPC ..... 347/8, 19
See application file for complete search history.

(56) References Cited

U.S. PATENT DOCUMENTS

| | | | | |
|---|---|---|---|---|
| 6,652,064 | B2 | 11/2003 | Bruch et al. | |
| 2002/0089562 | A1 | 7/2002 | Simons et al. | |
| 2003/0117455 | A1 * | 6/2003 | Bruch et al. | 347/23 |
| 2003/0218647 | A1 * | 11/2003 | Ogawa | 347/16 |
| 2006/0232623 | A1 * | 10/2006 | Murcia et al. | 347/20 |
| 2007/0103534 | A1 | 5/2007 | Shinohara et al. | |

FOREIGN PATENT DOCUMENTS

| | | | | |
|---|---|---|---|---|
| EP | 0710567 | A2 | 5/1996 | |
| EP | 1245399 | A2 | 10/2002 | |
| EP | 1452317 | A1 | 9/2004 | |
| JP | 08-282048 | A | 10/1996 | |
| JP | 2000-177199 | * | 6/2000 | B41J 25/308 |
| JP | 2000-177199 | A | 6/2000 | |
| JP | 2006-240026 | A | 9/2006 | |
| JP | 2007-130761 | A | 5/2007 | |

OTHER PUBLICATIONS

Machine translation of JP2000-177199 (Jun. 2000).*

* cited by examiner

*Primary Examiner* — Ryan Lepisto
(74) *Attorney, Agent, or Firm* — Birch, Stewart, Kolasch & Birch, LLP

(57) ABSTRACT

In a printer having a print head moveable relative to a recording medium, the recording medium and print head may touch each other, thereby possibly damaging the print head and/or the recording medium. In order to prevent further damage, it is advantageous to detect a medium touch as soon as possible. An available feedback signal relating to the print head, e.g. originating from a carriage on which the print head is mounted, is employed to determine whether a medium touch has occurred such that a dedicated medium touch or crash sensor may be omitted. A malfunctioning nozzle signal is used to determine a change in a number of malfunctioning nozzles to detect a medium touch. Alternatively, a print head position signal is used to determine a position error and derive from the position error whether or not a medium touch has occurred.

13 Claims, 2 Drawing Sheets

METHOD AND APPARATUS FOR DETECTING A MEDIA TOUCH OF AN INKJET PRINTHEAD

CROSS-REFERENCE TO RELATED APPLICATIONS

This application claims priority under 35 U.S.C. §119(a) to Application Ser. No. 08152526.3, filed in Europe on Mar. 10, 2008, the entirety of which is expressly incorporated herein by reference.

BACKGROUND OF THE INVENTION

1. Field of the Invention

The present invention relates to a method for detecting a media touch of a print head of an inkjet printer and an inkjet printer configured to perform the method of the present invention.

2. Description of Background Art

In a known inkjet printer, a print head scans along a recording medium, while ejecting ink drops from nozzles, usually arranged in a predetermined nozzle array. The ink drops are ejected corresponding to a predetermined pattern, thereby forming an image on the recording medium. Of course, the inkjet technology is not limited to ejecting ink. Other fluids may be ejected as well.

Further, it is known that the print head may touch the recording medium, while the print head scans along the recording medium. As a result, ink from a first nozzle having a first color may be smeared over an outer surface of the print head and may enter another nozzle of the print head, which other nozzle is arranged for ejecting ink of another color. Thereby, the smeared ink will pollute the other nozzle. Also, dirt like dust, paper fibers and the like may enter and pollute the nozzles. Due to the dirt, ink drops may be misdirected or the nozzle may become obstructed. On the other hand, the image on the recording medium may be smeared by the print head touching the recording medium.

In a known method, the print head is provided with a sensor system for sensing malfunctioning of nozzles. In the known method, printing an image may be cancelled or interrupted for cleaning, when it is detected that a relatively large number of nozzles is malfunctioning, irrespective of the cause of the malfunctioning. However, a corrective action may depend on the cause of the malfunctioning. Moreover, malfunctioning nozzles may become functioning again, if not operated for a certain period of time, depending on the cause of malfunctioning. In the latter case, printing does not need to be interrupted or cancelled. In the case of a medium touch, however, printing may need to be cancelled, since the print quality of the print is likely to be insufficient. Moreover, the print head probably needs cleaning in order to prevent (permanent) damage to the print head.

SUMMARY OF THE INVENTION

It is an object of the present invention to provide a method and corresponding apparatus for detecting a recording medium touch of the print head.

The object is achieved in the method and the printing apparatus according to the present invention.

In an embodiment of the method according to the present invention, the method comprises the steps of (a) receiving a feedback signal relating to the print head; (b) determining a status parameter of the print head from the feedback signal; (c) comparing the status parameter with a reference parameter; and (d) determining whether the print head has touched the medium based on a result of the comparison in the step of comparing.

The feedback signal may be any kind of feedback signal providing data relating to the print head. Such data may relate to the position of the print head, the temperature of the print head, any malfunctioning nozzles, and any other kind of obtainable information about the status and operation of the print head. Such a feedback signal is known, as above described, for determining a number of malfunctioning nozzles, for example.

The feedback signal is received and used for determining a status parameter of the print head. The status parameter may be any parameter suitable for determining whether or not the print head is operating as intended.

It is noted that the term "feedback signal" as used herein is intended not to include a signal received from a (dedicated) crash sensor, medium touch sensor, or the like. In particular, it is contemplated that such a crash sensor or medium touch sensor does not provide status information, but merely provides information about the occurrence of a particular event.

A first suitable aspect of the print head that may be employed for determining whether the print head and the recording medium have touched is the number of malfunctioning nozzles. More in particular, if the number of malfunctioning nozzles increases relatively rapidly, it may be assumed that something, in particular the recording medium, has touched the nozzles of the print head. Therefore, in an embodiment, the feedback signal comprises data relating to the (mal)functioning of the nozzles of the print head. From said data, a number of malfunctioning nozzles is determined. The number of malfunctioning nozzles is then compared to a previously determined number of malfunctioning nozzles. If the number of malfunctioning nozzles has significantly increased, it is assumed that a paper touch has occurred. As above mentioned, the number of malfunctioning nozzles as such may not be a good indicator for a paper touch, since there are numerous other causes for malfunctioning. However, a significantly rapid change in the number of malfunctioning nozzles is a good indicator. Of course, in an embodiment, the reference parameter is selected such that a (small) change of the number of malfunctioning nozzles due to other causes does not lead to an erroneous detection of a medium touch.

If the printing apparatus comprises a plurality of print heads and/or a print head has a plurality of nozzle arrays, the arrangement of the plurality of nozzle arrays may be such that a first nozzle array may touch the medium and another nozzle array does not, or the other nozzle array may touch the medium later, it may be advantageous to detect a medium touch on the basis of an analysis of the feedback signal, in particular the signal indicating the number of malfunctioning nozzles, of each nozzle array separately. In such an embodiment, for example, as soon as a first nozzle array touches the medium, it may be possible to stop printing and thereby preventing another nozzle array from touching the medium as well.

Another aspect of the operation of the print head that is suitable to determine a medium touch is a relative position. For example, the print head should be at a predetermined position relative to the recording medium. If the position deviates from the predetermined relative position, the print head is not operating correctly. Hence, in an embodiment, the feedback signal comprises a print head-position signal suitable for determining an actual position of the print head relative to the recording medium and the actual relative position is used to determine a position error indicating a deviation of the actual position from a reference position. If the position error is larger than a predetermined maximum allowable error, it may be determined that the print head and the recording medium have touched.

It is noted that in a well known embodiment of an inkjet printer, the print head is configured to scan along the recording medium in a scanning direction, while the recording medium is configured to be moved in a medium advance direction, wherein the scanning direction and the medium advance direction are perpendicular with respect to each other. The present invention is however not limited to such an embodiment. For example, the print head may have such dimensions in the above-mentioned scanning direction that the print head may remain stationary, while the recording medium is being moved in the medium advance direction. In such an embodiment, the medium may also touch the print head resulting in the above-indicated problems.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1A:
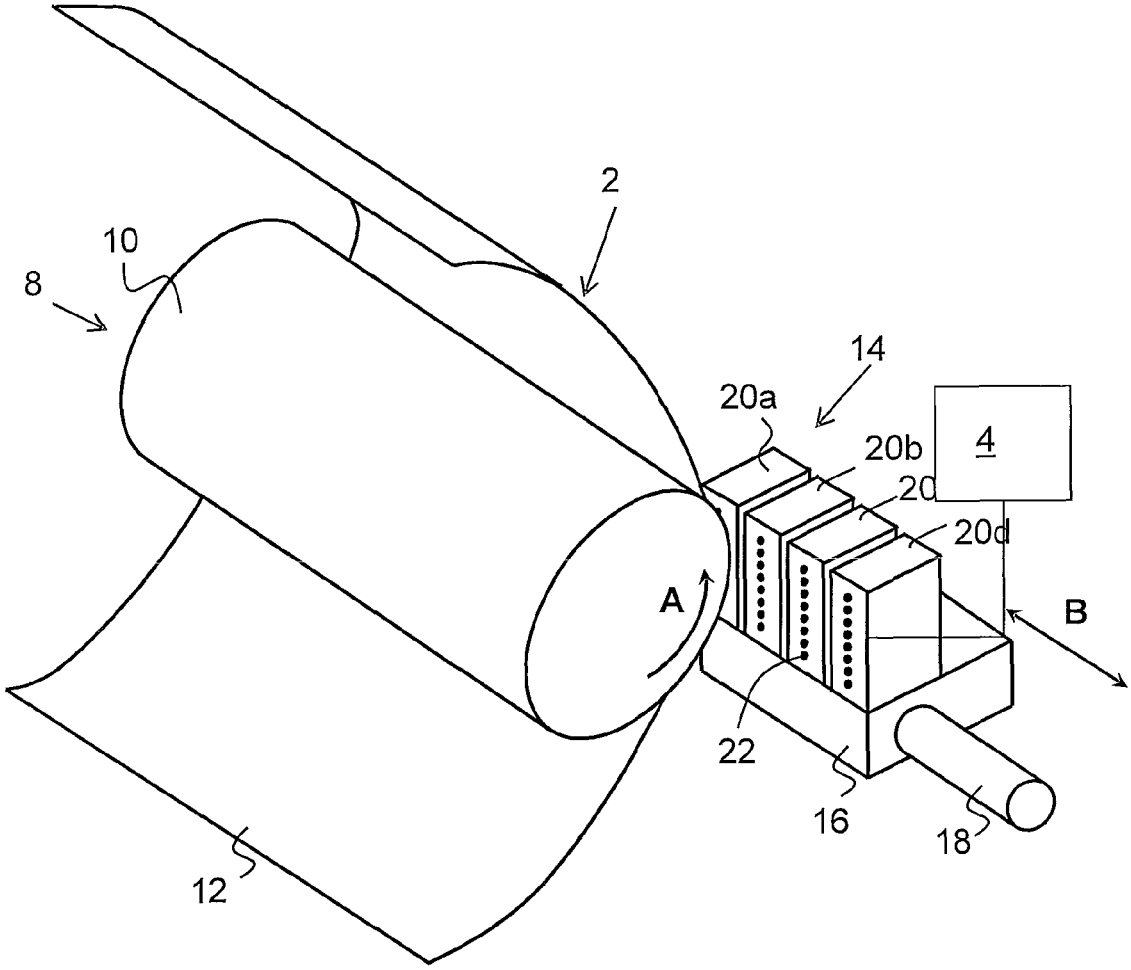
FIG. 1A is a representation of an embodiment of an inkjet printer.

The present invention will now be described with reference to the accompanying drawings, wherein the same reference numerals have been used to identify the same or similar elements throughout the several views.

FIG. 1A illustrates an embodiment of an inkjet printer 2. The printer 2 comprises a medium advance device 8 and a recording device 14.

In the illustrated embodiment, a recording medium 12, e.g. paper or any other suitable medium for image-wise receiving ink drops from the inkjet printer 2, is moveable by means of the medium advance device 8. In the illustrated embodiment, the medium advance device 8 comprises a platen 10. The medium advance device 8 is configured to move the medium 12 with respect to the recording device 14 in a direction A, which is hereinafter referred to as the medium advance direction A.

The recording device 14 comprises a set of nozzles 22. The nozzles 22 are arranged on four print heads 20*a*-20*d*. The print heads 20*a*-20*d* are configured to eject ink drops from the nozzles 22 such that the ink drops may impinge on the medium 12 at a substantially predetermined position. The four print heads 20*a*-20*d* may each be configured to eject ink of a same color, e.g. black ink to generate a black image on the recording medium 12, or the print heads 20*a*-20*d* may each eject ink of a different color, e.g. cyan, magenta, yellow and black (CMYK), for generating a full color image on the recording medium 12.

The four print heads 20*a*-20*d* are arranged on a carriage 16 which is moveably supported on a guide rail 18. Thus, the carriage 16 is moveable in a scanning direction B. Hence, the four print heads 20*a*-20*d* are moveable with respect to the recording medium 12 in said scanning direction B. By suitably controlling the movement of the carriage 16 and the movement of the medium 12 in the medium advance direction A, while suitably controlling the ejection of ink drops from the nozzles 22 of the print heads 20*a*-20*d*, the printer 2 is enabled to generate an image on the recording medium 12. Such a printing method is well known in the art and is therefore not further elucidated herein.

It is noted that the method according to the present invention is not limited to an embodiment of a printer according to the exemplary, schematically illustrated printer of FIG. 1A. The method according to the present invention may be applicable to any kind of printer in which two elements, for example a recording element and a recording medium, are moveable with respect to each other.

Figure 1B:
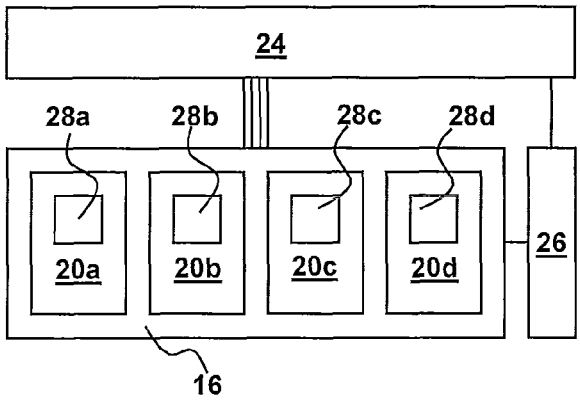
FIG. 1B is a representation of at least a part of a control system for use in the embodiment of an inkjet printer of FIG. 1A.

FIG. 1B illustrates an exemplary control system 4 for use in the printer 2 according to FIG. 1A. The control system 4 comprises a controller 24. The controller 24 is operatively connected to a position sensor 26 and nozzle failure detectors 28*a*-28*d* arranged on each print head 20*a*-20*d*, respectively.

The position sensor 26 is configured to determine a position of the carriage 16 relative to a predetermined other part of the printer 2, thereby for example providing information about the position of the carriage 16 with respect to the recording medium 12. The position sensor 26 may be provided on the carriage 16 or may be provided on a base frame, e.g. the guide rail 18. In an embodiment, the position sensor 26 may comprise a first part arranged on the carriage 16 and a second part arranged on the base frame such as the guide rail 18. In general, any embodiment of a position sensor/detector that is suitable for sensing/detecting a position of the carriage 16 or at least the print heads 20*a*-20*d* with respect to another part of the printer 2 may be used in the present invention.

The nozzle failure detectors 28*a*-28*d* are configured to determine whether or not each nozzle 22 is functioning correctly. For example, a nozzle 22 may be blocked by dirt or an air bubble may negatively influence the ejection behavior of a nozzle 22. If an irregularity is detected by the nozzle failure detectors 28*a*-28*d*, the controller 24 is provided with an indication of (a number of) the malfunctioning nozzle(s), possibly complemented with relevant information about the probable cause of malfunctioning. The nozzle failure detectors 28*a*-28*d* may be any suitable kind of detector. For example, each print head 20*a*-20*d* may be provided with dedicated sensors for sensing a state of each nozzle (or group of nozzles). In a particular embodiment, the nozzles 22 are actuated by means of a piezo-actuator. Such a piezo-actuator may be employed, after actuation, as a sensor for determining an acoustic reflection present in the print head 20*a*-20*d* after such an actuation. From the acoustic reflection it may de determined whether or not the nozzle 22 is functioning correctly. In general, any suitable kind of sensor may be used for performing the method according to the present invention.

The controller 24 may be dedicated for performing the method according to the present invention or the controller 24 may be configured to control the recording device 14 in general, e.g. for controlling the movement of the carriage 16 along the guide rail 18 and controlling the ink ejection from the nozzles 22 of the print heads 20*a*-20*d*, including performing the method according to the present invention.

In operation, the recording medium 12 and the recording device 14, in particular the nozzles 22 of the print heads 20*a*-20*d*, should not touch, since this may cause smearing of ink on the recording medium 12 and/or may damage the print heads 20*a*-20*d*. However, for accurately positioning the ink drops at the predetermined position on the recording medium 12, it is advantageous to maintain a very small distance between the recording medium 12 and the nozzles 22. Consequently, if the recording medium 12 is not correctly positioned on the platen 10, for example having air bubbles between the platen 10 and the recording medium 12, the distance between the recording medium 12 and the nozzles 22 may be decreased and the print heads 20*a*-20*d* may touch the recording medium 12. Likewise, a dirt particle, or the like, may get between the print heads 20*a*-20*d* and the recording medium 12 and may be pressed into one of the nozzles 22, thereby possibly blocking and possibly even damaging the nozzle 22. In any case, if a direct mechanical contact between the recording medium 12 and the nozzles 22 occurs, it is advantageous to detect such contact in order to determine whether corrective action is needed, e.g. to prevent (further) damage to the print heads 20*a*-20*d* and/or damage to the recording medium 12 and the image generated on the recording medium 12. Corrective actions may include, but are not limited to, breaking off the print job and cleaning the print heads 20*a*-20*d* by e.g. wiping and/or purging the nozzles 22.

In accordance with the present invention, a medium touch such as above described may be detected without employing a dedicated sensing system by suitably analyzing signals that are fed back from the carriage 16 and/or print heads 20*a*-20*d*.

Figure 2:
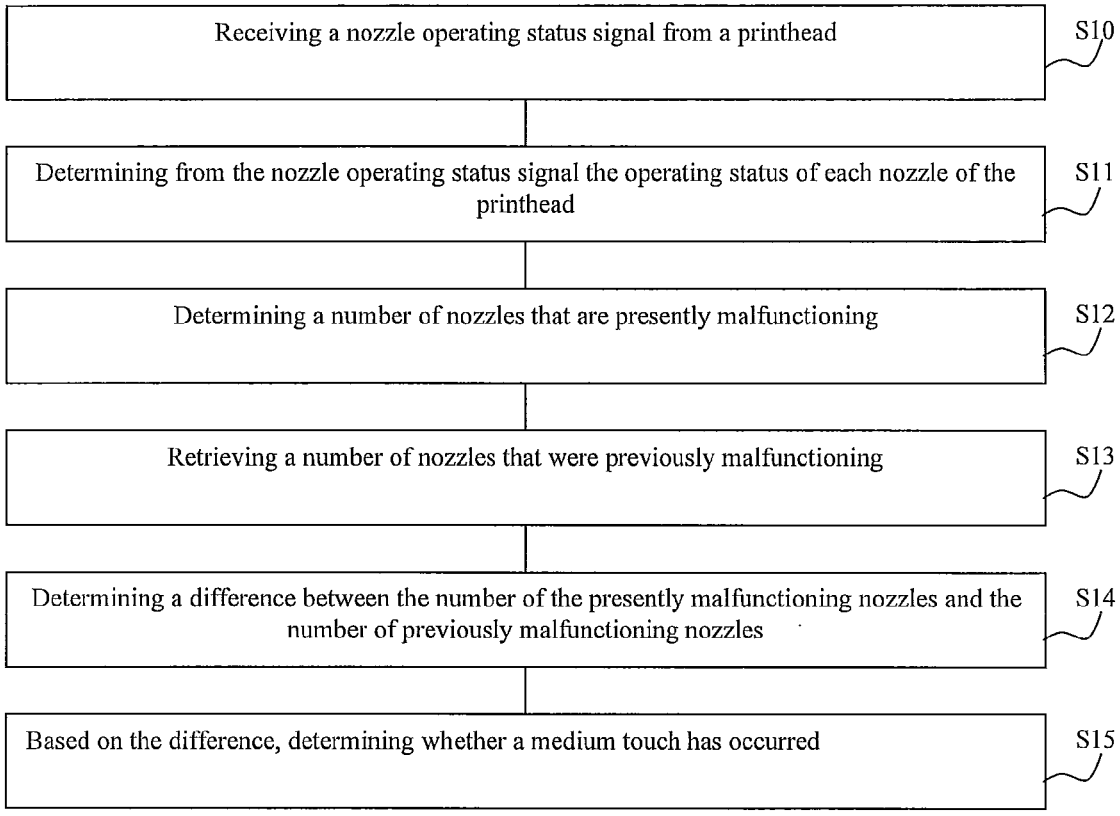
FIG. 2 is a workflow diagram for illustrating a first embodiment of a method according to the present invention.

In a first embodiment of the method according to the present invention and as illustrated in FIG. 2, the signal received from the nozzle failure detectors 28*a*-28*d* is used to detect a medium touch. In a first step S10 of the illustrated embodiment, a nozzle operating status signal is received from the respective nozzle failure detectors 28*a*-28*d* of the print heads 20*a*-20*d*. The nozzle operating status signal may have any kind of format. Therefore, in step S11, the nozzle operating status signal is used to determine an operating status of each nozzle of each print head 20*a*-20*d*. In an embodiment, instead of determining a status for each separate nozzle, it may be conceivable to determine such a signal for each of a number of predetermined groups of nozzles.

In a third step S12, a number of malfunctioning nozzles is determined. It is noted that in another embodiment of the method according to the present invention, the second step may be omitted, if the nozzle operating status signal is formatted such that the number of malfunctioning nozzles is directly derivable from the nozzle operating status signal.

In another step S13, which may have been performed prior to the previous steps S10-S12 or in parallel with the previous steps S10-S12, a number of malfunctioning nozzles that has been determined previously, e.g. in a preceding execution of a method of determining a number of malfunctioning nozzles, is retrieved from a memory, for example. In a particular embodiment, for example, the number of malfunctioning nozzles is determined at a turning point of the carriage 16 at each end of the guide rail 18 (see FIG. 1). Therefore, after each stroke of the carriage 16 from a first end of the guide rail 18 to a second end of the guide rail 18, a number of malfunctioning nozzles is determined. Then, while performing the method of FIG. 2 at the second end of the guide rail 18, in step S13, the number of malfunctioning nozzles that were previously present at the first end, where the stroke was started, is retrieved.

In step S14, a change in the number of malfunctioning nozzles is determined. Referring to the above-described embodiment, the change of the number indicates a change of the number of malfunctioning nozzles that has occurred during the stroke of the carriage from the first end of the guide rail to the second end.

In step S15 it is considered that if a medium touch has occurred, a relatively large change in the number of malfunctioning nozzles will have occurred, since the medium touch will have resulted in dirt and paper dust being pressed into the nozzles and/or air bubbles being generated in the nozzles. However, since such malfunctioning may also occur without a medium touch, the determined difference in the number of malfunctioning nozzles may be compared to a predetermined threshold, for example, in order to prevent that it is erroneously determined that a medium touch has occurred.

The method of FIG. 2 may be performed for all print heads together, per print head or per group of nozzles, for example. In particular, considering that the outer print heads 20*a* and 20*d* are most likely to touch a medium first, it may be advantageous to detect the change in the number of malfunctioning nozzles per print head.

In a particular embodiment, not only the change in the number of malfunctioning nozzles is used to detect a paper touch. In such an embodiment, a position of the malfunctioning nozzles, and in particular the newly malfunctioning nozzles, may be taken into consideration upon determining whether a medium touch has occurred, or not. For example, an outer surface of the print head, in which surface the nozzles are provided, has been damaged due to, e.g. earlier medium touches, the nozzles thereof are more likely to entrap an air bubble. Thus, a group of nozzles of such a print head may—as a group—become more vulnerable to malfunctioning. Therefore, if a relatively large increase in the number of malfunctioning nozzles is determined, while the newly malfunctioning nozzles are spatially grouped and/or are part of a single print head, it may be determined that the nozzles are damaged and thus that such an increase in the number of malfunctioning nozzles is not a result of a medium touch. Moreover, in a further embodiment, these nozzles may be excluded from further use in the method according to the present invention.

The embodiment of the method according to FIG. 2 may be performed during a normal printing operation, but may also be performed without performing a printing operation. For example, during calibration using a calibration device such as a vision system, or the like, that is arranged on the carriage (such a calibration method is well known in the art and is not further elucidated here), the carriage may be required to scan and move along the recording medium. Hence, there is a possibility that the printhead and the recording medium touch each other. Therefore, even without printing, the status of each nozzle may be (periodically) observed, and in case of a significant and rapid increase in the number of nozzles that is not in a normal operation state, it may be decided that the print head has touched something. In response thereto, an action such as cleaning or the like may be initiated.

Figure 3:
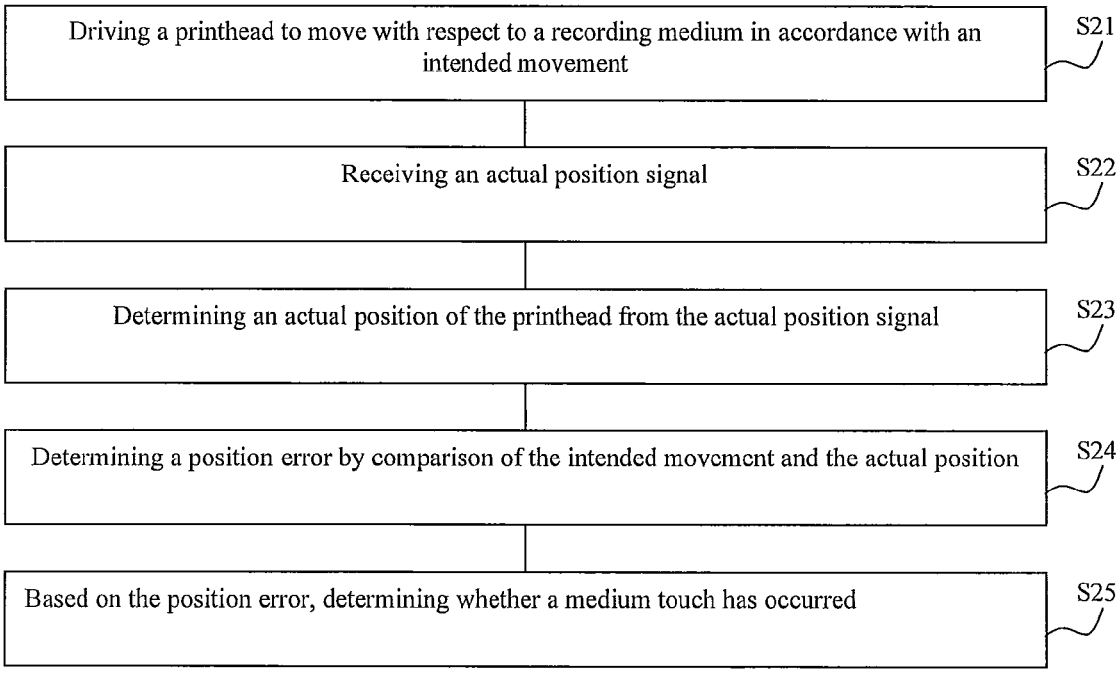
FIG. 3 is a workflow diagram for illustrating a second embodiment of a method according to the present invention.

FIG. 3 illustrates another embodiment of the method according to the present invention. In operation, e.g. a printing operation, the carriage scans along the recording medium or the platen (in case of the embodiment as illustrated in FIG. 1A) based on a predetermined intended movement. Then, in accordance with step S21, the carriage is driven to move in accordance with such a predetermined intended movement. The intended movement is such that a position of the carriage at each moment in time is at least derivable. Thus, the position may be expressed as a function of time.

While driving the carriage, an actual position signal is received by a control system from, e.g. the position sensor 26 (see FIG. 1B), in accordance with step S22. The actual position signal relates to an actual position of the print head(s). Thus the control system receives a feedback signal enabling the control system to accurately control the movement of the carriage based on a comparison of an actual position derived from the actual position signal (step S23) and the predetermined intended position, the latter being provided as a reference signal, for example. The comparison may for example provide a position error as a function of time (step S24). Such a position control method is well known in the art.

The position error may be advantageously used to determine whether a medium touch of the print head or carriage with the recording medium (or any other element like, e.g. dirt) has occurred. If a medium touch occurs, the mechanical resistance against movement increases. Since the control system could not anticipate such an increase in mechanical resistance, the carriage will not move in accordance with the intended movement and consequently the position error will be relatively large. Therefore, if the position error becomes larger than a predetermined (acceptable) position error, it may be determined that a medium touch has occurred.

In an embodiment, the position error is compared with a predetermined threshold. If the absolute position error is larger than the threshold, it is determined that a medium touch has occurred. In a particular embodiment, the threshold varies with an intended acceleration (or deceleration) of the carriage. As a position error may become relatively large when the carriage has a relatively large acceleration (or deceleration), the threshold may be set larger compared to a time at which the carriage has no acceleration or only a relatively small acceleration (or deceleration). For example, during a printing operation, the carriage may move uniformly, i.e. at a substantially constant speed without accelerating, but at the end of the guide rail (see FIG. 1A), the carriage needs to reverse direction, requiring a relatively large deceleration and a relatively large acceleration. As the position error may become large at the moments when the acceleration is large, and in order to prevent an erroneous detection of a medium touch, the threshold may be selected relatively large, if a relatively large acceleration is assumed.

In an embodiment of the control system according to the present invention, the position control may become more accurate during the operation of the printer. For example, based on previously needed control adaptations during the movement of the carriage, the control system may adapt the control parameters already prior to the movement of the carriage such that any systematic deviations become smaller during operation. Due to the reduction of systematic deviations, the control method becomes more accurate and the position error threshold may be selected relatively small.

As with the embodiment of FIG. 2 as above explained, the embodiment of the method as illustrated in FIG. 3 may be employed during a printing operation, but also during any other movement of the carriage.

Further, the embodiments described in detail with reference to FIG. 2 and FIG. 3, respectively, may be combined in a single embodiment. In particular, the embodiment of FIG. 2 is suitable for detecting even slight medium touches, while the embodiment of FIG. 3 appears better suited for in-line detection of more severe medium touches. Further, the embodiment according to FIG. 3 is also suited for detecting touches of the recording medium with carriage parts other than print heads.

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. In particular, features presented and described in separate dependent claims may be applied in combination and any advantageous combination of such claims is herewith disclosed. Further, the terms and phrases used herein are not intended to be limiting; but rather, to provide an understandable description of the invention.

The terms "a" or "an," as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method for detecting a media touch of a print head of a printing apparatus during a printing operation, the print head and a recording medium being arranged to be moveable with respect to each other, the method comprising the steps of:

receiving a feedback signal relating to a status of the print head during the printing operation, wherein during the printing operation, the print head is maintained at a distance from a platen, the recording medium being arranged on the platen;

determining from the feedback signal a status parameter of the print head;

comparing the status parameter with a reference parameter; and determining whether the print head has touched the medium based on a result of the comparison in said step of comparing, wherein the feedback signal comprises a malfunctioning-nozzles signal, the malfunctioning-nozzles signal being suitable for deriving a number of malfunctioning nozzles of the print head and wherein the status parameter of the print head is determined from the derived number of malfunctioning nozzles.

2. The method according to claim 1, wherein said step of determining the status parameter is performed before and after moving at least one of the print head and the recording medium with respect to the other one, and said step of determining the status parameter further comprises determining a change in a number of malfunctioning nozzles after said moving by comparing the number of malfunctioning nozzles after said moving with the number of malfunctioning nozzles before said moving, the status parameter determined in said step of determining the status parameter being the change in the determined number of malfunctioning nozzles, the reference parameter indicating a threshold value for said change.

3. The method according to claim 2, wherein the print head comprises at least two nozzle arrays and wherein the malfunctioning-nozzles signal is suitable for deriving a number of malfunctioning nozzles per nozzle array, the status parameter of the print head being determined from the derived number of malfunctioning nozzles, the method further comprising performing said steps of determining the status parameter and comparing the status parameters per nozzle array.

4. The method according to claim 2, wherein at least two print heads are provided, each print head comprising at least one nozzle array and wherein the malfunctioning-nozzles signal is suitable for deriving a number of malfunctioning nozzles per nozzle array, the status parameter of the print head being determined from the derived number of malfunctioning nozzles, the method further comprising performing said steps of determining the status parameter and comparing the status parameters per nozzle array.

5. The method according to claim 1, wherein the print head comprises at least two nozzle arrays and wherein the malfunctioning-nozzles signal is suitable for deriving a number of malfunctioning nozzles per nozzle array, the status parameter of the print head being determined from the derived number of malfunctioning nozzles, the method further comprising performing said steps of determining the status parameter and comparing the status parameters per nozzle array.

6. The method according to claim 1, wherein at least two print heads are provided, each print head comprising at least one nozzle array and wherein the malfunctioning-nozzles signal is suitable for deriving a number of malfunctioning nozzles per nozzle array, the status parameter of the print head being determined from the derived number of malfunctioning nozzles, the method further comprising performing said steps of determining the status parameter and comparing the status parameters per nozzle array.

7. The method according to claim 1, further comprises:

determining a position of the malfunctioning nozzles relative to each other;

determining whether the malfunctioning nozzles are damaged nozzles based on the position of the malfunctioning nozzles; and when it is determined that some of the malfunctioning nozzles are the damaged nozzles, excluding the damaged nozzles from use in the step of determining whether the print head has touched the medium, wherein the step of determining whether the print head has touched the medium is performed based on the malfunctioning nozzles that are not excluded in the excluding step.

8. The method according to claim 1, further comprising:

controlling movement of the print head in a direction parallel to a platen where the recording medium is positioned based on the feedback signal.

9. A method for detecting a media touch of a print head of a printing apparatus during a printing operation, the print head and a recording medium being arranged to be moveable with respect to each other, the method comprising the steps of:

receiving a feedback signal relating to a status of the print head during the printing operation, wherein during the printing operation, the print head is maintained at a distance from a platen, the recording medium being arranged on the platen;

determining from the feedback signal a status parameter of the print head;

comparing the status parameter with a reference parameter; and determining whether the print head has touched the medium based on a result of the comparison in said step of comparing, wherein the feedback signal comprises a print head-position signal, the print head-position signal being suitable for deriving an actual position of the print head with respect to the recording medium, the status parameter being determined from the actual position of the print head, wherein said step of comparing the status parameters further comprises comparing the print head-position signal with a reference position signal indicating an intended position of the print head, the status parameter of the print head indicating a position error, the position error indicating a deviation of the actual position from the intended position, the reference parameter corresponding to a threshold value for the position error, and wherein the threshold value is dynamically adapted based on at least one of the parameters comprised in the group of parameters comprising speed of the print head, acceleration of the print head and previously needed control adaptations.

10. A printing apparatus for printing an image on a recording medium, the printing apparatus comprising:

a print head arranged to be moveable with respect to the recording medium;

a control system operatively coupled to the print head for receiving a feedback signal relating to a status of the print head during a printing operation, wherein during the printing operation, the print head is maintained at a distance from a platen, the recording medium being arranged on the platen, the control system being configured to determine a status parameter of the print head from the feedback signal, to compare the determined status parameter with a reference parameter and to determine from a result of the comparison whether the print head and the recording medium have touched during the printing operation, wherein the print head is an inkjet print head, the feedback signal comprising a malfunctioning-nozzles signal, the malfunctioning-nozzles signal being suitable for deriving a number of malfunctioning nozzles, the status parameter of the print head being determined from the number of malfunctioning nozzles derived before and after a movement of at least one of the print head and the recording medium with respect to the other one and wherein the control system is configured to determine whether a medium touch has occurred based on a change in the number of malfunctioning nozzles.

11. The printing apparatus according to claim 10, wherein the control system receives the feedback signal and controls movement of the print head in a direction parallel to a platen where the recording medium is positioned based on the feedback signal.

12. A computer readable medium comprising computer readable instructions for instructing a computer to perform a method for detecting a media touch of a print head of a printing apparatus during a printing operation, the print head and a recording medium being arranged to be moveable with respect to each other, the method comprising the steps of:

receiving a feedback signal relating to a status of the print head during the printing operation, wherein during the printing operation, the print head is maintained at a distance from a platen, the recording medium being arranged on the platen;

determining from the feedback signal a status parameter of the print head;

comparing the status parameter with a reference parameter; and determining whether the print head has touched the medium based on a result of the comparison in said step of comparing, wherein the feedback signal comprises a malfunctioning-nozzles signal, the malfunctioning-nozzles signal being suitable for deriving a number of malfunctioning nozzles of the print head and wherein the status parameter of the print head is determined from the derived number of malfunctioning nozzles.

13. The computer readable medium according to claim 12, wherein the method further comprises:

controlling movement of the print head in a direction parallel to a platen where the recording medium is positioned based on the feedback signal.

* * * * *